US005573042A

United States Patent [19]

De Haen

[11] Patent Number: 5,573,042

[45] Date of Patent: Nov. 12, 1996

[54] PROCESS FOR THE PREPARATION OF PREFILLED SYRINGES WITHOUT RESIDUAL GAS BUBBLES

[75] Inventor: Christoph De Haen, Milan, Italy

[73] Assignee: Dibra S.p.A., Milan, Italy

[21] Appl. No.: 448,845

[22] Filed: May 24, 1995

[30] Foreign Application Priority Data

May 16, 1995 [IT] Italy ..... MI95A0988

[51] Int. Cl.[6] ..... B65B 1/04; B65B 3/04

[52] U.S. Cl. ..... 141/2; 141/5; 141/8; 141/18; 141/27

[58] Field of Search ..... 141/1, 2, 18, 21, 141/23, 25, 26, 27, 113, 319, 325, 326, 327, 5, 7, 8, 59, 60, 61, 11

*Primary Examiner*—Henry J. Recla
*Assistant Examiner*—Timothy L. Maust
*Attorney, Agent, or Firm*—Bucknam and Archer

[57] ABSTRACT

A process for the production of prefilled syringes free from dangerous residual air or gas bubbles, in short production times.

5 Claims, No Drawings

PROCESS FOR THE PREPARATION OF PREFILLED SYRINGES WITHOUT RESIDUAL GAS BUBBLES

In vivo diagnostic contrast media, in particular those for X-ray and MR imaging, must be administered to patients at a controlled rate and quantity. This need is usually met through the use of automatic injectors, which allow a correct administration of the foreseen large volumes for said diagnostic contrast solutions (up to 250 ml and beyond of composition).

Most of said injectors, in particular high pressure ones, preferably use plastic syringes, due to economical and safety problems.

The injectors can be equipped either with an empty syringe, which is automatically filled before the use, or with a prefilled syringe, the latter solution being preferable, since it grants a better sterility and a more correct dosage. However, in both cases the residual air or gas in the syringe must be totally expelled by the same before the administration of the diagnostic agent, to avoid that a bubble is injected to the patient thus jeopardizing his or her life.

Despite the fact that clear operating procedures regarding the elimination of residual gas or air bubbles have been ruled out and tested, every year a certain number of lethal events occurs, due to the imprecise or incorrect application of said procedures.

For this reason it could be highly desirable to manufacture prefilled syringes without a considerable, dangerous content of air bubbles. Unfortunately, today's technology does not foresee a practical and economical system to achieve this result.

Up to now various processes for the preparation of prefilled syringes have been disclosed. For instance, U.S. Pat. No. 4,628,969 and U.S. Pat. No. 4,718,463 (Mallinckrodt) disclose a process in which the injectable solution is loaded in the syringe end-opening, while the nozzle (where the needle will be mounted) is sealed by a suitable removable cap. The syringe is then assembled under vacuum by inserting the sealing plunged. Obviously the applied vacuum is quite modest: in fact is limited by the liquid vapour pressure, since under depression conditions, boiling must be avoided to prevent the squirt from the syringe. As a matter of fact, from a technical point of view this theoretical limit cannot be achieved. As a result, after inserting the sealing plunger, the volume between the liquid and said plunger is compressed to atmospheric pressure, leaving a gas or air bubble, whose size depends on the amount of liquid loaded in the syringe and on the difference between the applied vacuum and the liquid vapour pressure. The presence of a gas bubble is consequently inevitable.

U.S. Pat. No. 5,207,983 (Sterling Winthrop) discloses a process in which the liquid is loaded into the syringe through the nozzle while the end part is previously sealed by the piston plunger. Subsequently, said nozzle is sealed by a suitable removable cap. If said sealing is carried out under vacuum (as previously described) the residual gas bubble could be disregarded. However, the reduced size of the syringe tip hole allows only the introduction of very thin needles: as a consequence, the filling of the syringe, especially when manufacturing syringes for large volume solutions, requires long times, which is not industrially viable.

Another problem connected to a process of this type, is the possible production of foam during the filling, thus causing longer global production times.

Patent application WO 94/13541 (Mallinckrodt) discloses the filling of an empty syringe closed both by the plunger and the tip removable cap. Said operation is carried out through a side access which is sealed when the filling has ended. Not even this system can solve the problems connected to the two mentioned drawbacks, i.e. the unacceptable presence of a residual gas bubble, and too long filling times.

This invention discloses a process which overcomes the above mentioned drawbacks, allowing the production of prefilled syringes free from dangerous residual air or gas bubbles, in short production times.

Said process comprises the following steps:

the syringe nozzle is temporarily sealed with a suitable removable cap, from the opposite open end of said syringe at least 80%, preferably 95% or more of the desired volume/dosage solution to be injected is loaded, then the plunger-piston is inserted under vacuum, the syringe is turned, the cap is removed and, through the nozzle, the syringe is completely filled With the remaining quantity of said solution to be injected, the syringe is re-sealed by re-inserting the cap on the tip, optionally under vacuum.

After these operations, the prefilled syringes can be sterilized and packed. In this way, products with no or minimal traces of residual gas bubbles are obtained, which products are not dangerous to the patient.

The whole production time of the process is industrially acceptable, since the slow part of the process, i.e. the filling through the syringe tip, concerns only a minimal part of the filling liquid.

The advantage is more evident when syringes containing high-volumes of injectable solutions are produced, such as 200–300 ml syringes.

This process is particularly suitable for the preparation of glass or plastic prefilled syringes containing injectable solutions to be administered through automatic injectors, i.e. under strictly controlled dosage and administration rate conditions.

A particularly preferred use regards the preparation of prefilled plastic syringes with contrast media solutions for diagnostic applications, where usually large volumes of highly concentrated and viscous solutions are administered.

I claim:

1. A process for the production of prefilled syringes free from residual gas or air bubbles in a dangerous amount for the patient's health, characterized by the following steps:

a syringe nozzle is temporarily sealed with a suitable removable cap, from an opposite opened end of said syringe at least 80% of a desired volume/dosage solution to be injected is loaded, then a plunger-piston is inserted under vacuum, the syringe is turned, the cap is removed and, through the nozzle, the syringe is completely filled with a remaining quantity of said solution to be injected, the syringe is re-sealed by re-inserting the cap on the tip of said syringe nozzle, optionally under vacuum.

2. A process according to claim 1, in which the amount of injectable solution loaded through the syringe open end is at least 95% of the total dosage, of said solution.

3. A prefilled syringe according to the process of claim 1, in which said syringe is filled with a pharmaceutical injectable solution.

4. A prefilled syringe according to the process of claim 1, in which said syringe is filled with a contrastographic injectable solution for in vivo diagnostic procedures.

5. A prefilled syringe according to the process of claim 1, in which said syringe is made of plastic.

* * * * *